US010593177B2

(12) United States Patent
Trani et al.

(10) Patent No.: US 10,593,177 B2
(45) Date of Patent: Mar. 17, 2020

(54) METHOD AND APPARATUS FOR TIERED ANALYTICS IN A MULTI-SENSOR ENVIRONMENT

(71) Applicant: SENSORMATIC ELECTRONICS, LLC, Boca Raton, FL (US)

(72) Inventors: James Trani, Billerica, MA (US); Gopi Subramanian, Bangalore (IN)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 0 days.

(21) Appl. No.: 15/071,464

(22) Filed: Mar. 16, 2016

(65) Prior Publication Data

US 2017/0270757 A1 Sep. 21, 2017

(51) Int. Cl.

*G08B 13/22* (2006.01)
*G08B 25/14* (2006.01)
*G08B 25/08* (2006.01)

(52) U.S. Cl.

CPC ..... *G08B 13/22* (2013.01); *G08B 25/08* (2013.01); *G08B 25/14* (2013.01)

(58) Field of Classification Search

CPC ..... Y02B 70/325; Y04S 20/228; G08B 13/00; G08B 13/19645; G08B 13/19656; G08B 15/001; G08B 13/19682; G08B 13/19684; G08B 25/001; H04B 2203/5458

USPC ..... 340/521, 539.1–539.19, 517

See application file for complete search history.

(56) References Cited

U.S. PATENT DOCUMENTS 10,374,821 B2 * 8/2019 Ansari ..... H04L 47/80
2004/0150519 A1 * 8/2004 Husain ..... G08B 13/19656 340/506
2005/0184867 A1 * 8/2005 Osann, Jr. ..... G05B 15/02 340/539.25
2005/0271250 A1 * 12/2005 Vallone ..... G06K 9/00288 382/103
2009/0077167 A1 * 3/2009 Baum ..... H04L 12/2809 709/203
2010/0115579 A1 * 5/2010 Rensin ..... G06F 21/313 726/1

(Continued)

OTHER PUBLICATIONS

International Search Report and Written Opinion, dated Apr. 13, 2017, PCT/US17/22641.

(Continued)

*Primary Examiner* — Emily C Terrell
(74) *Attorney, Agent, or Firm* — Foley & Lardner LLP

(57) ABSTRACT

Disclosed is a networked system for detecting conditions at a physical premises. The networked system includes a local computer system configure to read a configuration file that determines processing performed by the local computer system and evaluate collected sensor data with respect to the configuration file, for first sensor data to be processed by the local computer, and execute unsupervised learning models to continually analyze the first sensor data to produce operational states and detect drift sequences that are correlated to stored determined conditions. The networked system also includes a remote computer system that execute unsupervised learning models to continually analyze the collected sensor information. An alert is asserted by at least one of the local computer and the remote computer based on the determined conditions.

16 Claims, 12 Drawing Sheets

(56) References Cited

U.S. PATENT DOCUMENTS

| | | | | |
|---|---|---|---|---|
| 2012/0158161 | A1* | 6/2012 | Cohn | G08B 29/02 700/90 |
| 2013/0307682 | A1* | 11/2013 | Jerhotova | G06F 17/2785 340/521 |
| 2014/0266592 | A1* | 9/2014 | Dahl | H04W 88/16 340/5.71 |
| 2014/0266684 | A1* | 9/2014 | Poder | G08B 25/003 340/521 |
| 2015/0161882 | A1* | 6/2015 | Lett | G08B 25/001 340/506 |
| 2015/0364027 | A1 | 12/2015 | Haupt et al. | |
| 2016/0050264 | A1 | 2/2016 | Breed et al. | |

OTHER PUBLICATIONS

Supplementary European Search Report on EP 17767496.7, dated Oct. 25, 2019, 8 pages.

* cited by examiner

| Analytics listing | rule listing | rule listing |
|---|---|---|
| A1 | A1 R2, R3 | A1 r2, r7 |
| A2 | A2 R1 | A2 r4 |
| An | An R42, R45 | An r4 |

170, Config. file

FIG. 10

METHOD AND APPARATUS FOR TIERED ANALYTICS IN A MULTI-SENSOR ENVIRONMENT

BACKGROUND

This description relates to operation of sensor networks such as those used for security, intrusion and alarm systems installed on industrial or commercial or residential premises.

It is common for businesses to have various types of systems such as intrusion detection, fire detection and surveillance systems for detecting various alarm conditions at their premises and signaling the conditions to a monitoring station or authorized users. Other systems that are commonly found in businesses are access control systems have card readers and access controllers to control access, e.g., open or unlock doors, etc. These systems use various types of sensors such as motion detectors, cameras, and proximity sensors, thermal, optical, vibration sensors and so forth.

Typical multi-sensor systems deployed in residential and commercial buildings gather data by sensors that is fed into a unified location (typically referred to as a panel) such that relevant decisions can be made by the panel. For example, intrusion detection systems include an intrusion detection panel that receives sensors deployed on windows and doors that communicate information to the intrusion detection panel regarding states of the sensors, e.g., opened or closed or in the process of being forced. The intrusion panel receives that information and evaluates the information to determine if an intrusion has occurred and if the police or monitoring company needs to be notified. In other systems all of such data is sent to a secondary system for processing.

SUMMARY

In the disclosed approach data is analyzed by the local panel and then distributed to a secondary system for additional processing.

According to an aspect, a networked system for detecting conditions at a physical premises includes a local computer system including a processing device, memory operatively coupled to the processing device and a storage device storing a computer program product for detecting conditions at the physical premises, the computer program product comprising instructions to configure the local computer to read a configuration file that determines processing performed by the local computer system, collect the sensor information from plural sensors deployed in the premises, the sensors configured with an identity of the premises and physical objects being monitored by the sensors in the identified premises, evaluate collected sensor data with respect to the configuration file, for first sensor data to be processed by the local computer, execute one or more unsupervised learning models to continually analyze the first sensor data to produce operational states of sensor information, sequences of state transitions, and detect that one or more of the sequences of state transitions is a drift sequences by correlating the one or more determined drift state sequences to one or more stored determined conditions.

The networked system also includes a remote computer system including a processing device, memory operatively coupled to the processing device; and a storage device storing a computer program product, the computer program product for detecting conditions at the physical premises, the computer program product comprising instructions to cause a processor to receive the collected sensor information from a network, the collected sensor information including the identity of the premises and identity of the physical objects being monitored by the sensors in the identified premises, execute one or more unsupervised learning models to continually analyze the collected sensor information to produce operational states of sensor information and produce sequences of state transitions and detect that one or more of the sequences of state transitions is a drift sequence by correlating determined drift state sequences to one or more stored determined conditions, generate an alert by at least one of the local computer and the remote computer based on the determined condition, and send the generated alert to a user device.

Aspects also include computer program products and methods.

The details of one or more embodiments of the invention are set forth in the accompanying drawings and the description below. Other features, objects, and advantages of the invention is apparent from the description and drawings, and from the claims.

DESCRIPTION OF DRAWINGS

FIG. 10 is block diagram of an example of a configuration file.

DETAILED DESCRIPTION

Described herein are surveillance/intrusion/fire/access systems that are wirelessly connected to a variety of sensors. In some instances those systems may be wired to sensors. Examples of detectors/sensors 28 (sensor detectors used interchangeably) include motion detectors, glass break detectors, noxious gas sensors, smoke/fire detectors, contact/proximity switches, video sensors, such as camera, audio sensors such as microphones, directional microphones, temperature sensors such as infrared sensors, vibration sensors, air movement/pressure sensors, chemical/electro-chemical sensors, e.g., VOC (volatile organic compound) detectors. In some instances, those systems sensors may include weight sensors, LIDAR (technology that measures distance by illuminating a target with a laser and analyzing the reflected light), GPS (global positioning system) receivers, optical, biometric sensors, e.g., retina scan sensors, EGG/Heartbeat sensors in wearable computing garments, network hotspots and other network devices, and others.

The surveillance/intrusion/fire/access systems employ wireless sensor networks and wireless devices, with remote, cloud-based server monitoring and report generation. As described in more detail below, the wireless sensor networks wireless links between sensors and servers, with the wireless links usually used for the lowest level connections (e.g., sensor node device to hub/gateway).

In the network, the edge (wirelessly-connected) tier of the network is comprised sensor devices that provide specific sensor functions. These sensor devices have a processor and memory, and may be battery operated and include a wireless network card. The edge devices generally form a single wireless network in which each end-node communicates directly with its parent node in a hub-and-spoke-style architecture. The parent node may be, e.g., a network access point (not to be confused with an access control device or system) on a gateway or a sub-coordinator which is, in turn is connected to the access point or another sub-coordinator.

Figure 1:
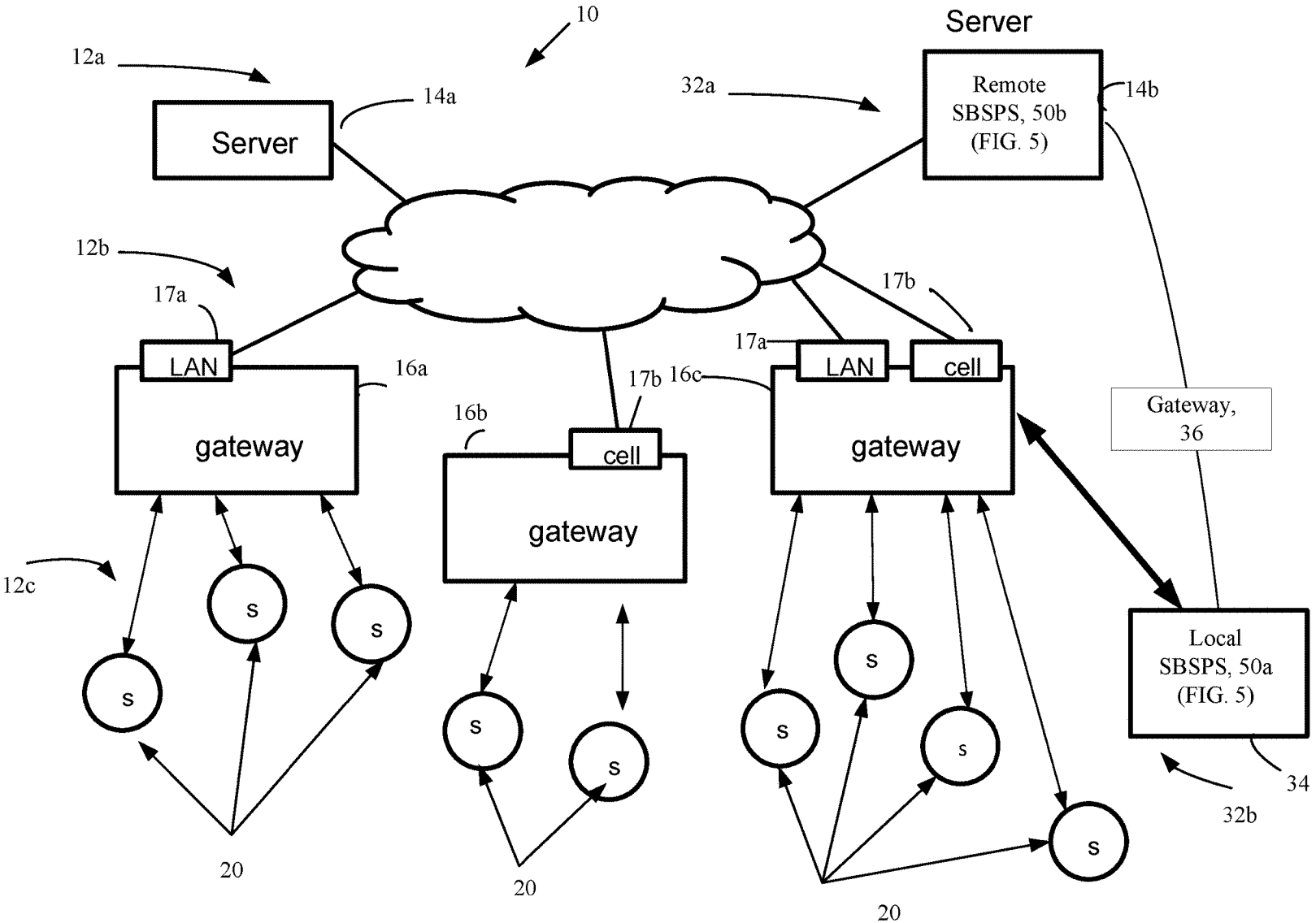
FIG. 1 is a schematic diagram of an exemplary networked security system.

Referring now to FIG. 1, an exemplary (global) distributed network topology for a wireless sensor network 10 is shown. In FIG. 1 the wireless sensor network 10 is a distributed network that is logically divided into a first set of tiers or hierarchical levels 12*a*-12*c*.

In an upper tier or hierarchical level 12*a* of the first set of tiers (or hierarchical levels) 12*a*-12*c* of the network are disposed servers and/or virtual servers 14*a*, 14*b* running a "cloud computing" paradigm that are networked together using well-established networking technology such as Internet protocols or which can be private networks that use none or part of the Internet. Applications that run on those servers 14*a*, 14*b* communicate using various protocols such as for Web Internet networks XML/SOAP, RESTful web service, and other application layer technologies such as HTTP and ATOM. The distributed network 10 has direct links between devices (nodes) as shown and discussed below.

In one implementation hierarchical level 12*a* includes a central monitoring station (not shown) comprised of one or more of the server computers 14*a*, 14*b* and which includes or receives information from a sensor based state prediction system 50 as will be described below.

The distributed network 10 includes a second logically divided tier or hierarchical level 12*b* of the first set of tiers (or hierarchical levels) 12*a*-12*c*, referred to here as a middle tier that involves gateways 16 located at central, convenient places inside individual buildings and structures. These gateways 16 communicate with servers 14 in the upper tier whether the servers are stand-alone dedicated servers and/or cloud based servers running cloud applications using web programming techniques. The middle tier gateways 16 are also shown with both local area network 17*a* (e.g., Ethernet or 802.11) and cellular network interfaces 17*b*.

The distributed network topology also includes a lower tier (edge layer) 12*c* of the first set of tiers (or hierarchical levels) 12*a*-12*c*, which comprised a set or set of devices that involve fully-functional sensor nodes 18 (e.g., sensor nodes that include wireless devices, e.g., transceivers or at least transmitters, which in FIG. 1 are marked in with an "F"), as well as wireless sensor nodes or sensor end-nodes 20 (marked in the FIG. 1 with "C"). In some embodiments wired sensors (not shown) can be included in aspects of the distributed network 10.

In a typical network, the edge (wirelessly-connected) tier 12*c* of the network is largely comprised of devices with specific functions. These devices have a small-to-moderate amount of processing power and memory, and often are battery powered, thus requiring that they conserve energy by spending much of their time in sleep mode. A typical model is one where the edge devices generally form a single wireless network in which each end-node communicates directly with its parent node in a hub-and-spoke-style architecture. The parent node may be, e.g., an access point on a gateway or a sub-coordinator which is, in turn, connected to the access point or another sub-coordinator.

Each gateway is equipped with an access point (fully functional sensor node or "F" sensor node) that is physically attached to that access point and that provides a wireless connection point to other nodes in the wireless network. The links (illustrated by lines not numbered) shown in FIG. 1 represent direct (single-hop MAC layer) connections between devices. A formal networking layer (that functions in each of the three tiers shown in FIG. 1) uses a series of these direct links together with routing devices to send messages (fragmented or non-fragmented) from one device to another over the network.

Still referring to FIG. 1, a second set 30 of tiers (a processing set of tiers) 32*a*-32*b* is shown adjacent with the first set of tiers (or hierarchical levels) 12*a*-12*c*. The second set 30 of tiers includes a upper tier or hierarchical level 32*a* that is part of the first set 12 hierarchical level 12*a* of servers and/or virtual servers 14*a*, 14*b* running a "cloud computing" paradigm, as discussed above. that are networked together using well-established networking technology such as Internet protocols or which can be private networks that use none or part of the Internet) 32*a*-32*b* is shown adjacent with the first set of tiers (or hierarchical levels) 12*a*-12*c*. In FIG. 1, the first set 12 of hierarchical level 12*a* level of servers 14*a*, 14*b* run different instances and configurations of a sensor based state prediction system 50 (discussed below). Server 14*a* runs a configuration of the sensor based state prediction system 50 that performs all processing of sensor signals, whereas server 14*b* runs an instance 50*b* of the sensor based state prediction system 50 that cooperatively processes sensor signals with a local instance 50*a* of the sensor based state prediction system 50. The remote instance 50*b* of the sensor based state prediction system 50 on server 14*a* receives sensor signals from the gateway 16*c*, whereas local server 34 receives the sensor signals either from the gateway 16*c* (via a connection) or directly from the sensors devices (generally 20).

In FIG. 1 three gateways and three sets of sensor devices 20 are shown. Each gateway can represent a unique physical premises or the gateways can be part of the same physical premises. A gateway 36 is also shown to make direct connections, through the cloud to the server 14*b*.

Figure 2:
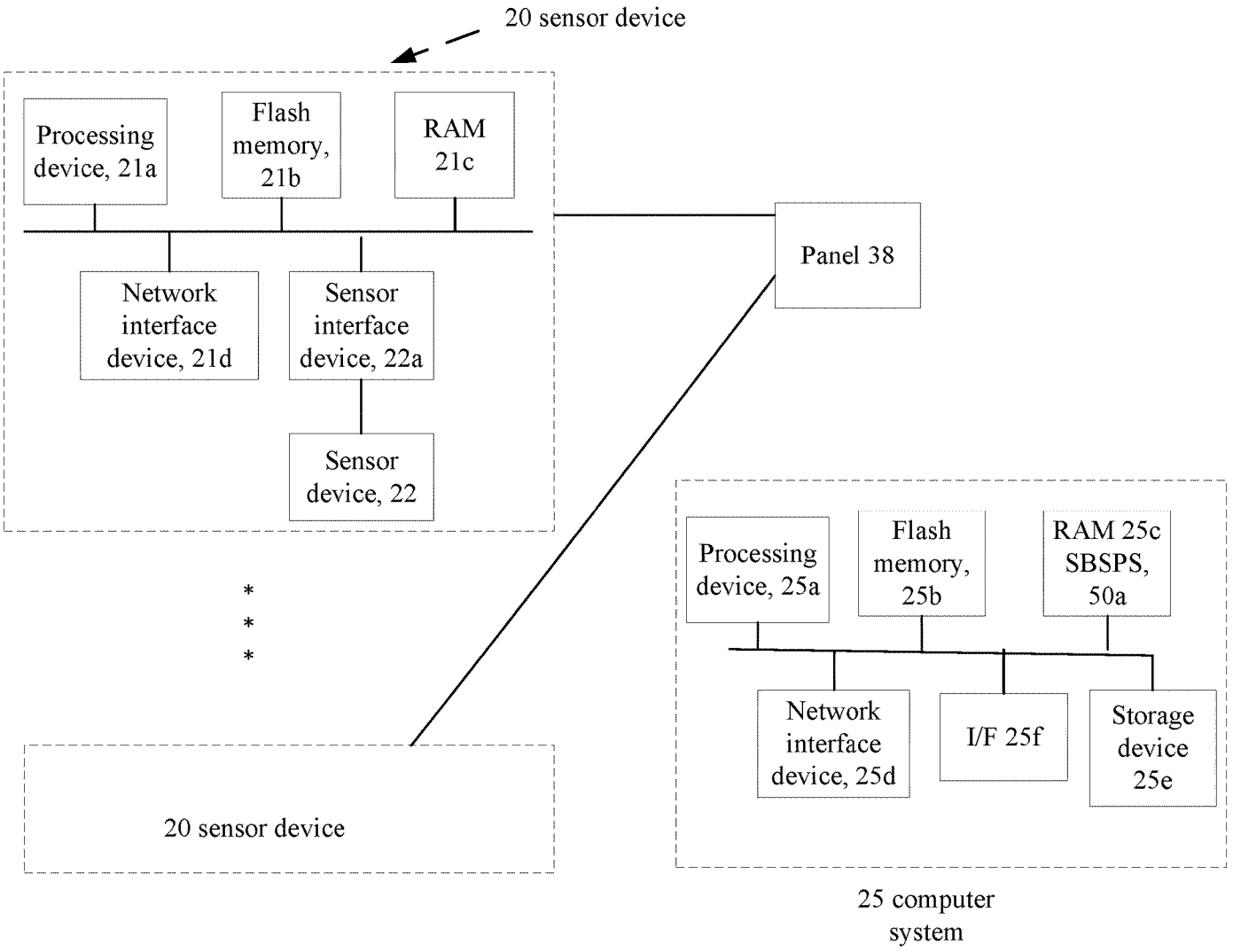
FIG. 2 is a block diagram of a sensor.

Referring to FIG. 2, details of the sensor devices 20 are shown. Each sensor device 20 includes a processor device 21*a*, e.g., a CPU and or other type of controller device that executes under an operating system, generally with 8-bit or 16-bit logic, rather than the 32 and 64-bit logic used by high-end computers and microprocessors. The device 20 has a relatively small flash/persistent store 21*b* and volatile memory 21*c* in comparison with other the computing devices on the network. Generally, the persistent store 21*b* is about a megabyte of storage or less and volatile memory 21*c* is about several kilobytes of RAM memory or less. The device 20 has a network interface card 21*d* that interfaces the device 20 to the network 10. Typically, a wireless interface card is used, but in some instances a wired interface could be used. Alternatively, a transceiver chip driven by a wireless network protocol stack (e.g., 802.15.4/6LoWPAN) can be used as the (wireless) network interface. These components are coupled together via a bus structure. The device 20 also includes a sensor element 22 and a sensor interface 22*a* that interfaces to the processor 21*a*. Sensor 22 can be any type of sensor types mentioned above.

Also shown in FIG. 2 is a panel 38. Panel 38 may be part of an intrusion detection system (not shown). The panel 38, i.e., intrusion detection panel is coupled to plural sensors/detectors 20 (FIG. 1) disbursed throughout the physical premises. The intrusion detection system is typically in communication with a central monitoring station (also referred to as central monitoring center not shown) via one or more data or communication networks (not shown). Sensor/detectors may be hard wired or communicate with the panel 38 wirelessly. In general, detectors sense glass breakage, motion, gas leaks, fire, and/or breach of an entry point, and send the sensed information to the panel 38. Based on the information received from the detectors 20, the panel 38, e.g., intrusion detection panel determines whether to trigger alarms and/or sending alarm messages to the monitoring station 20. A user may access the intrusion detection panel to control the intrusion detection system, e.g., disarm, arm, enter predetermined settings, etc. Other systems can also be deployed such as access control systems, etc.

Also shown is a computer system 25 that includes a processor device 25*a*, e.g., a CPU that executes under an operating system, generally with 32-bit or 64-bit logic as used by high-end computers and microprocessors. The device 25 may have flash memory 25*b* and has a persistent store 25*e* and volatile memory 25*c*. The computer system 25 includes a network interface card 25*d* that interfaces the device 25 to the network 10. Typically a wireless interface card is used, but in some instances a wired interface could be used. Alternatively, a transceiver chip driven by a wireless network protocol stack (e.g., 802.15.4/6LoWPAN) can be used as the (wireless) network interface. These components are coupled together via a bus structure. The computer 25 can also include interfaces 25*f* such as for a display/monitor, and other user devices.

Figure 3:
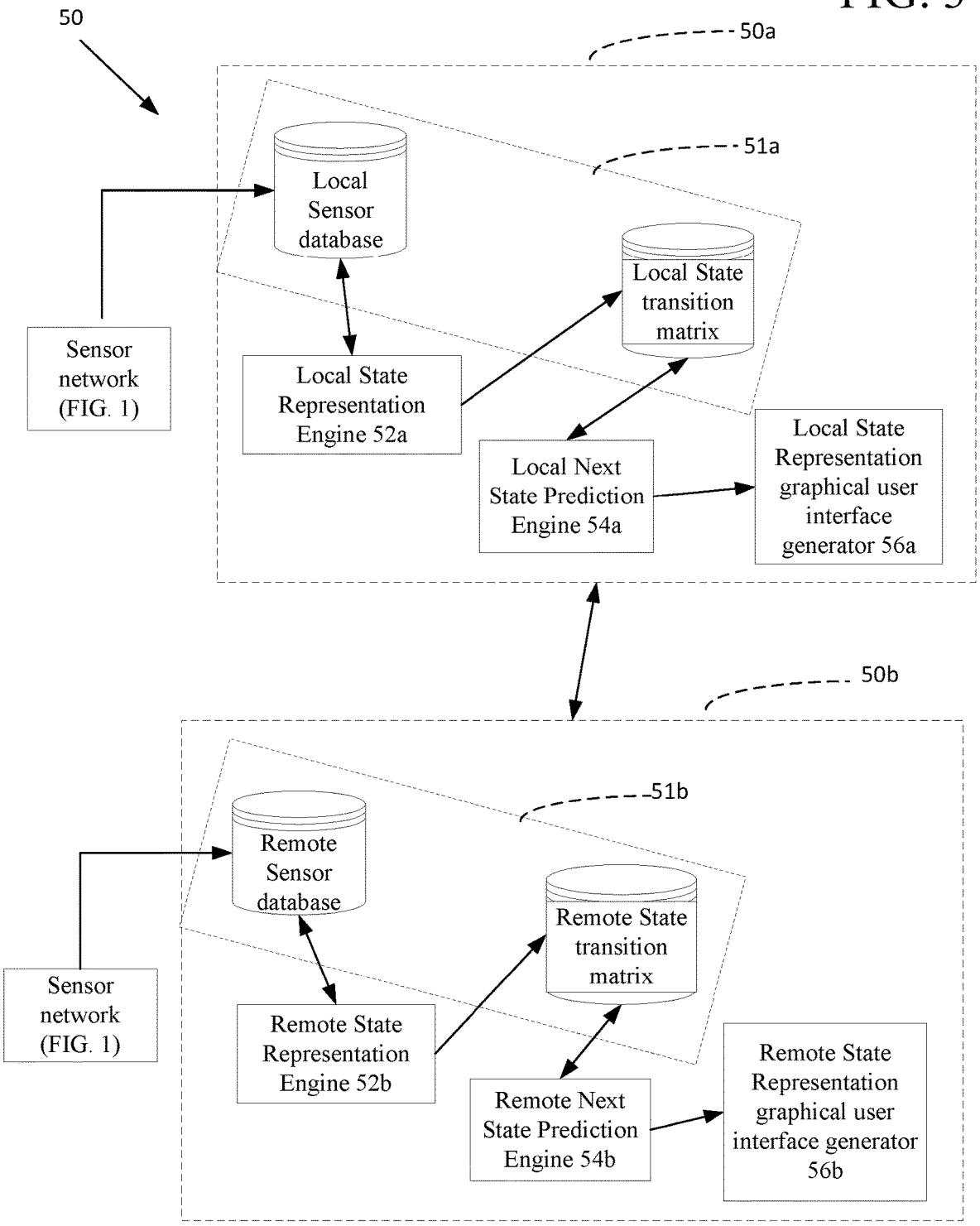
FIG. 3 is a block diagram of a tiered sensor based state prediction system.

Referring now to FIG. 3, the sensor based state prediction system 50 is shown. In embodiments where all processing is performed in the cloud based servers (not explicitly shown), the sensor based state prediction system 50 would be residing only on the cloud base server(s) 14*a*, 14*b*. In the embodiment described below, the prediction system 50 includes a local subsystem 50*a* and a remote subsystem 50*b*.

The local subsystem 50*a* executes on the computer system 25 local to the panel 38 (FIG. 2) and accesses database(s) 51*a*. The remote subsystem 50*b* executes on one or more of the cloud-based server computers and accesses database(s) 51*b* that store sensor data and store state data in a state transition matrix. In some implementations, dedicated server computers could be used as an alternative for the remote subsystem 50*b*.

The sensor based state prediction system 50 includes State Representation Engines 52*a*, 52*b*. The State Representation Engines 52*a*, 52*b* executes on the local computer 25 and one or more of the servers 14, respectively, described above and interfaces on the servers receive sensor signals from a large plurality of sensors deployed in various premises throughout an area. These sensor signals have sensor values and together with other monitoring data represent a data instance for a particular area of a particular premises in a single point in time. The data represent granular information collected continuously from the particular premises. The State Representation Engine 52*a* and 52*b* each takes these granular values and converts the values into a semantic representation. For example, a set of sensor values and monitoring data for particular time duration are assigned a label, e.g., "State-1." As the data is collected continuously, this Engines 52*a*, 52*b* work in an unsupervised manner, as discussed below, to determine various states that may exist in the premises.

As the different states are captured, the Engines 52*a*, 52*b* also determine state transition metrics that are stored in the form a state transition matrix. A simple state transition matrix has all the states in its rows and columns, with cell entries being many times did the premises move from a state in cell i to a state in cell j are over a period of time and/or events. This matrix captures the operating behavior of the system. State transitions can happen either over time or due to events. Hence, the state transition metrics are captured using both time and events. A state is a representation of a group of sensors grouped according to a clustering algorithm.

The State transition matrix is a data structure that stores how many times the environment changed from State_i to State_j. The State transition matrix thus stores "knowledge" that the sensor based state prediction system 50 captures and which is used to determine predictions of the behavior of the premises. The State transition matrix is accessed by the Next prediction engine to make decisions and trigger actions by the sensor based state prediction system 50.

Unsupervised learning e.g., clustering is used to group sensor readings into states and conditions over a period of time that form a time trigger state and over events to form an event trigger state. Used to populate the state transition matrix per premises.

An exemplary simplified depiction for explanatory purposes of a State transition matrix is set out below:

| Instance | State transition | State transition | State transition | State transition | State transition | State transition |
|---|---|---|---|---|---|---|
| | x, y | x, y | x, y | x, y | x, y | x, y |
| | x, y | x, y | x, y | x, y | x, y | x, y |
| | x, y | x, y | x, y | x, y | x, y | x, y |

Where columns in the State transition matrix is are "state transitions" expressed as a listing by instance with pointer to the state time and event trigger tables.

Entries x,y in cells of the State transition matrix are pointers that corresponds to the trigger tables that store the number of time periods and events respectively for each particular cell of the State transition matrix.

The State time trigger is depicted below. The State time trigger tracks the time periods t1. . . t8 for each state transition corresponding to the number x in each particular cell.

| | t1 | t2 | t3 | *** |
|---|---|---|---|---|
| Instance | State transition 1 | State transition 2 | State transition 3 | *** |
| | 1 | 1 | 1 | *** |
| | 1 | 1 | 1 | *** |
| | t1 t5 | t2 t3 | t4 t7 t8 | *** |

State event trigger tracks the events E1 . . . E2 for each state transition corresponding to the number y in each particular cell (if any).

| | e1 | e2 | e3 | *** |
|---|---|---|---|---|
| Instance | State transition 1 | State transition 2 | State transition 3 | *** |
| | | | E2 | *** |
| | | | E2 | *** |
| | E1 | E1 | E3 | *** |

The State Representation Engines 52*a*, 52*b* in addition to populating the State transition matrix, also populate a State time trigger that is a data structure to store, the time value spent in each state and a distribution of the time duration for each state. Similar to the State transition matrix, the State time trigger also encapsulates the behavior knowledge of the environment. State transitions can be triggered using these values.

The State Representation Engines 52*a*, 52*b* also populate a State event trigger. The State event trigger is a data structure to store, event information. An example of an event can be sensor on a door sensing that a door was opened. There are many other types of events. This data structure captures how many times such captured events caused a state transition.

The State Representation Engines 52*a*, 52*b* populate the State Transition matrix and the State Time and State triggers, which together capture metrics, which provide a Knowledge Layer of the operational characteristics of the premises.

The sensor based state prediction system 50 also includes Next State Prediction Engines 54*a*, 54*b*. The Next State Prediction Engines 54*a*, 54*b* predict an immediate Next state of the premises based the state transition matrix. The Next State Prediction Engines 54*b* predicts if the premises will be in either a safe state or a drift state over a relatively long period of time the future, whereas Next State Prediction Engines 54*a*, predicts if the premises will be in either a safe state or a drift state over relatively shorter periods of time in relation to engine 54*b*.

The short period of time as used herein refers to a defined window of time in the future, which is limited to periods of less than a day up to real time, so that a response team has sufficient time to address a condition that is predicted by the Next State Prediction Engine 54*a*, whereas the long period of time can overlap the short period of time and can extend out to weeks or months.

The sensor based state prediction system 50 also includes a State Representation graphical user interface generators 56*a*, 56*b*. State Representation graphical user interface generators 56*a*, 56*b* provide graphical user interfaces that are used by the response team to continuously monitor the state of the premises. The State Representation graphical user interface generators 56*a*, 56*b* receive data from the Next State Prediction Engines 54*a*, 54*b*, respectively, to graphically display whether the premises is either in the safe state or the drifting state. The State Representation graphical user interface generator 56 operates as an Action Layer, where an action is performed based on input from Knowledge and Decision Layers.

The sensor based state prediction system 50 applies unsupervised algorithm learning models to analyze historical and current sensor data records from one or more customer premises and generates a model that can predict Next patterns, anomalies, conditions and events over a time frame that can be expected for a customer site. The sensor based state prediction system 50 produces a list of one or more predictions that may result in on or more alerts being sent to one more user devices as well as other computing system, as will be described. The prediction system 50 uses various types of unsupervised machine learning models including Linear/Non-Linear Models, Ensemble methods etc.

Figure 3A:
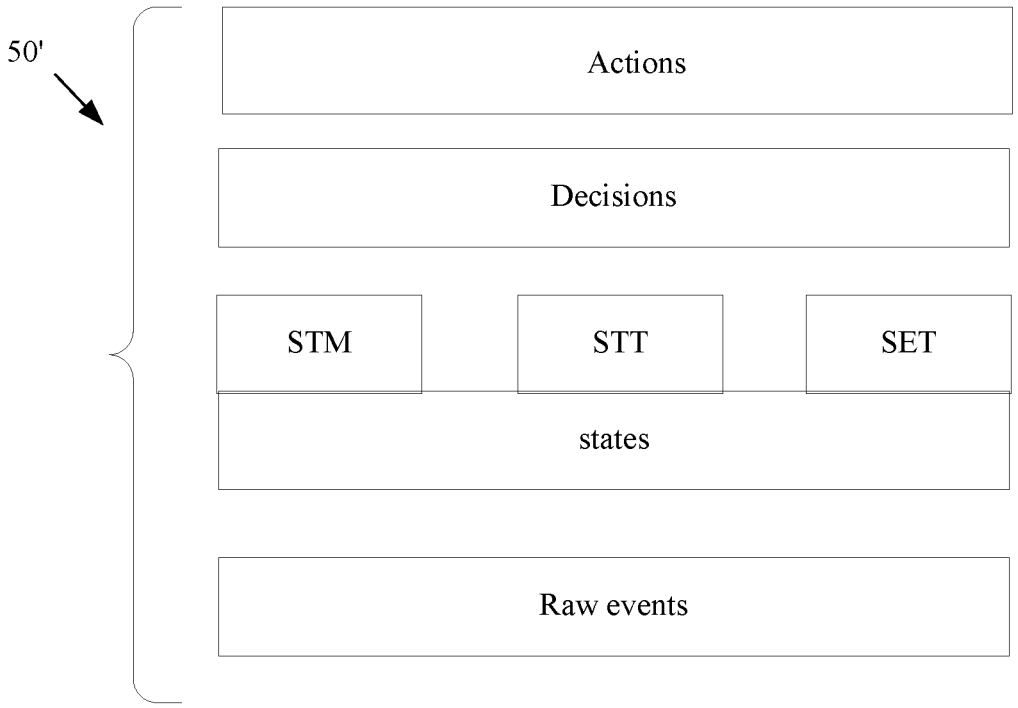
FIG. 3A is a diagram of a logical view of the tiered sensor based state prediction system of FIG. 3.

Referring now to FIG. 3A, a logical view 50' of the sensor based state prediction system 50 is shown. In this view, at the bottom is the raw events layer, that is, the sensors values and monitoring data from the environment under surveillance. The middle layer is an abstraction layer that abstracts these raw events as state (represented in FIG. 3A by the blocks "States" (State Representation Engines 52*a*, 52*b*), STM (State Transition Matrix), STT (State Time Trigger) and SET (State Event Trigger) that produce a state as a concise semantic representation of the underlying behavior information of the environment described by time and various sensor values at that point in time. With the upper blocks being a Decisions block (Next State Prediction Engine 54*a*, 54*b*) and Actions block (State Representation graphical user interface generator 56*a*, 56*b*.)

Figure 4:
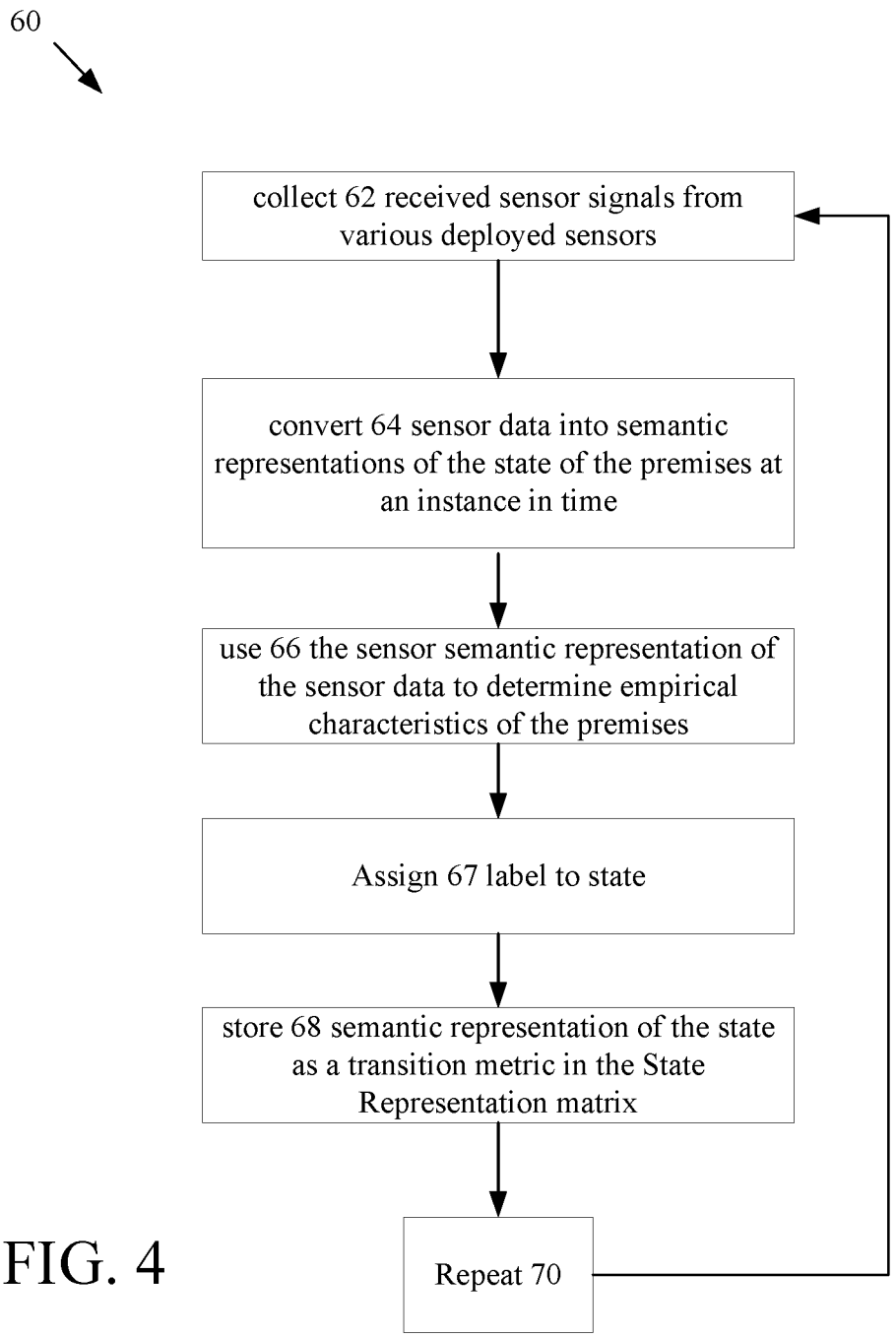
FIG. 4 is a flow diagram of a state representation engine.

Referring now to FIG. 4, the processing 60 for the State Representation Engines 52*a*, 52*b* is shown. Schematically, the processing 60 is similar for each engine 52*a*, 52*b*. The differences are in specific algorithms and the time periods of sensor data used by the algorithms. The State Representation Engines 52*a*, 52*b* collect 62 (e.g., from the databases 51 or directly from interfaces on the servers) received sensor signals from a large plurality of sensors deployed in various premises throughout an area that is being monitored by the sensor based state prediction system 50. The sensor data collected from the premises, includes collected sensor values and monitoring data values.

An example of the sensor values is shown below (using fictitious data):

Site no.: 448192
Kitchen thermostat: 69,
Stove thermostat: 72,
Outdoor security panel: Active,
Kitchen Lights: On,
Delivery Door: Shutdown As these sensor signals have sensor values that represent a data instance for a particular area of a particular premises in a single point in time, the State Representation Engines 52*a*, 52*b* convert 64 this sensor data into semantic representations of the state of the premises at instances in time. The State Representation Engines 52*a*, 52*b* use 66 the converted sensor semantic representation of the sensor data collected from the premises to determine the empirical characteristics of the premises. The State Representation Engines 52*a*, 52*b* assign 67 an identifier to the state.

For example, the kitchen in a restaurant example for a premises identified in the system as "Site no.: 448192" uses the sensor values to produce a first state that is identified here as "State 1." Any labelling can be used and is typically consecutive identified and this state is semantically described as follows:

State 1: Kitchen thermostat: 69, Stove thermostat: 72, Outdoor security panel: Active, Kitchen Lights: On, Delivery Door: Shutdown, current time: Monday 5:00 AM PST, start time: Sunday 10:00 PM PST The semantic description includes the identifier "State 1" as well as semantic descriptions of the various sensors, their values and dates and times.

The State Representation Engines 52*a*, 52*b* determine an abstraction of a collection of "events" i.e., the sensor signals as state. The state thus is a concise representation of the underlying behavior information of the premises being monitored, described by time and data and various sensor values at that point in time and at that date.

The semantic representation of the state is stored 68 by the State Representation Engines 52*a*, 52*b* as state transition metrics in the State Representation matrix. Over time and days, as the sensors produce different sensor values, the State Representation Engine 52 determines different states and converts these states into semantic representations that are stored the state transition metrics in the matrix, e.g., as in a continuous loop 70.

The kitchen example is further set out below:

The State Representation Engines 52*a*, 52*b* collects the following data (fictitious data) from these three sensors at a particular points in time,

| Obstruction Detector | Room Thermostat | Stove Thermostat |
|---|---|---|
| 0 | 71.1755732 | 78.95655605 |
| 0 | 68.27180645 | 79.97821825 |
| 0 | 71.80483918 | 79.428149 |
| 0 | 70.46354628 | 81.90901291 |
| 0 | 69.83508114 | 81.12026772 |
| 0 | 71.46074066 | 81.613552 |
| 1 | 70.14174204 | 80.12242015 |
| 1 | 70.98180652 | 78.03049081 |

The state representation engines 52*a*, 52*b*, converts these raw values into state definitions and assigns (labels) each with a unique identifier for each state, as discussed above. As the premises is operated over a period of time, the Next transition matrix, the state time trigger matrix and the state event trigger matrix are filled.

Continuing with the concrete example, the state representation engines 52*a*, 52*b* produces the following two states (State 1 is repeated here for clarity in explanation).

State 1: Kitchen thermostat: 69, Stove thermostat: 72, Outdoor security panel: Active, Kitchen Lights: On, Delivery Door: Shutdown, current time: Sunday 10:00 PM.

State 2: Kitchen thermostat: 69, Stove thermostat: 80, Outdoor security panel: Active, Kitchen Lights: On, Delivery Door: Shutdown, current time: Sunday 10:15 PM State 3: Kitchen thermostat: 69, Stove thermostat: 60, Outdoor security panel: Active, Kitchen Lights: On, Delivery Door: Shutdown, current time: Monday 1:00 AM.

Between State 1 and State 2 there is a transition in which over a 15 minute span the Stove thermostat value increased from 72 to 80 and from State 2 to State 3 the Stove thermostat value decreased from 80 to 72 over a 2 hr. and 45 min. period, which can likely be attributed to something being cooked between State 1 and State 2 and by State 3 the order was filled, item removed from stove and the stove thermostat shows a lower value.

The state representation engines 52*a*, 52*b*, add to the state transition matrix an entry that corresponds to this transition, that the premises moved from state 1 to state 2. The state representation engines 52*a*, 52*b*, also add to the state transition matrix in that entry, an indicator that the transition was "time trigger," causing the movement, and thus the state representation engines 52*a*, 52*b* add an entry in state time trigger matrix. The state representation engines 52*a*, 52*b*, thus co-ordinates various activities inside the premises under monitoring and captures/determines various operating characteristics of the premises.

Figure 5:
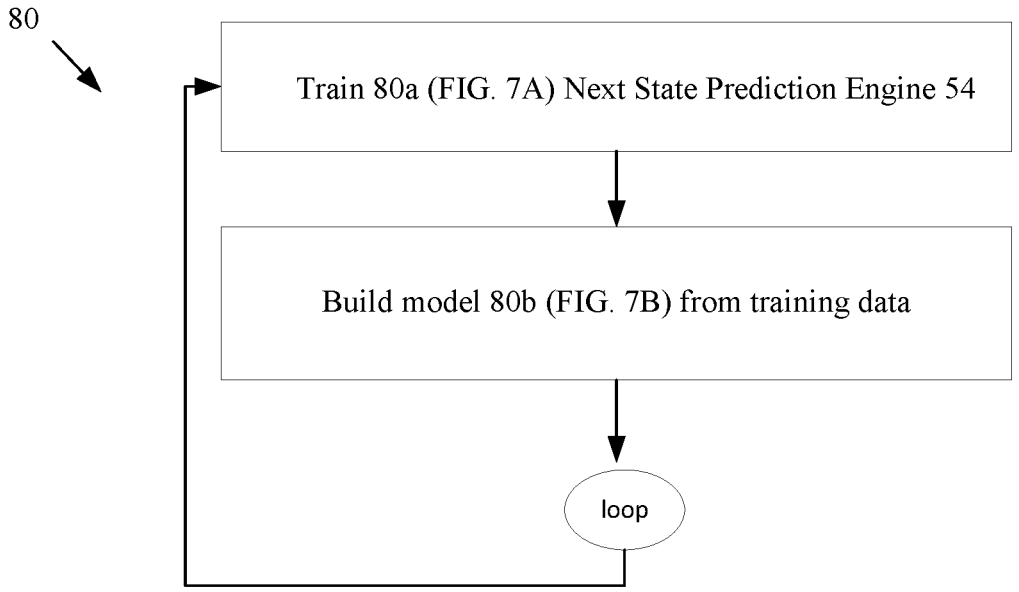
FIG. 5 is a flow diagram of tiered sensor based state prediction system processing.

Referring now to FIG. 5 processing 80 for the Next State Prediction Engine 54 is shown. This processing 80 includes training processing 80*a* (FIG. 5A) and model building processing 80*b* (FIG. 5B), which are used in operation of the sensor based state prediction system 50. Processing 80 is schematically similar for each of the Next State Prediction Engines 54*a*, 54*b* and thus will be discussed generically.

Figure 5A:
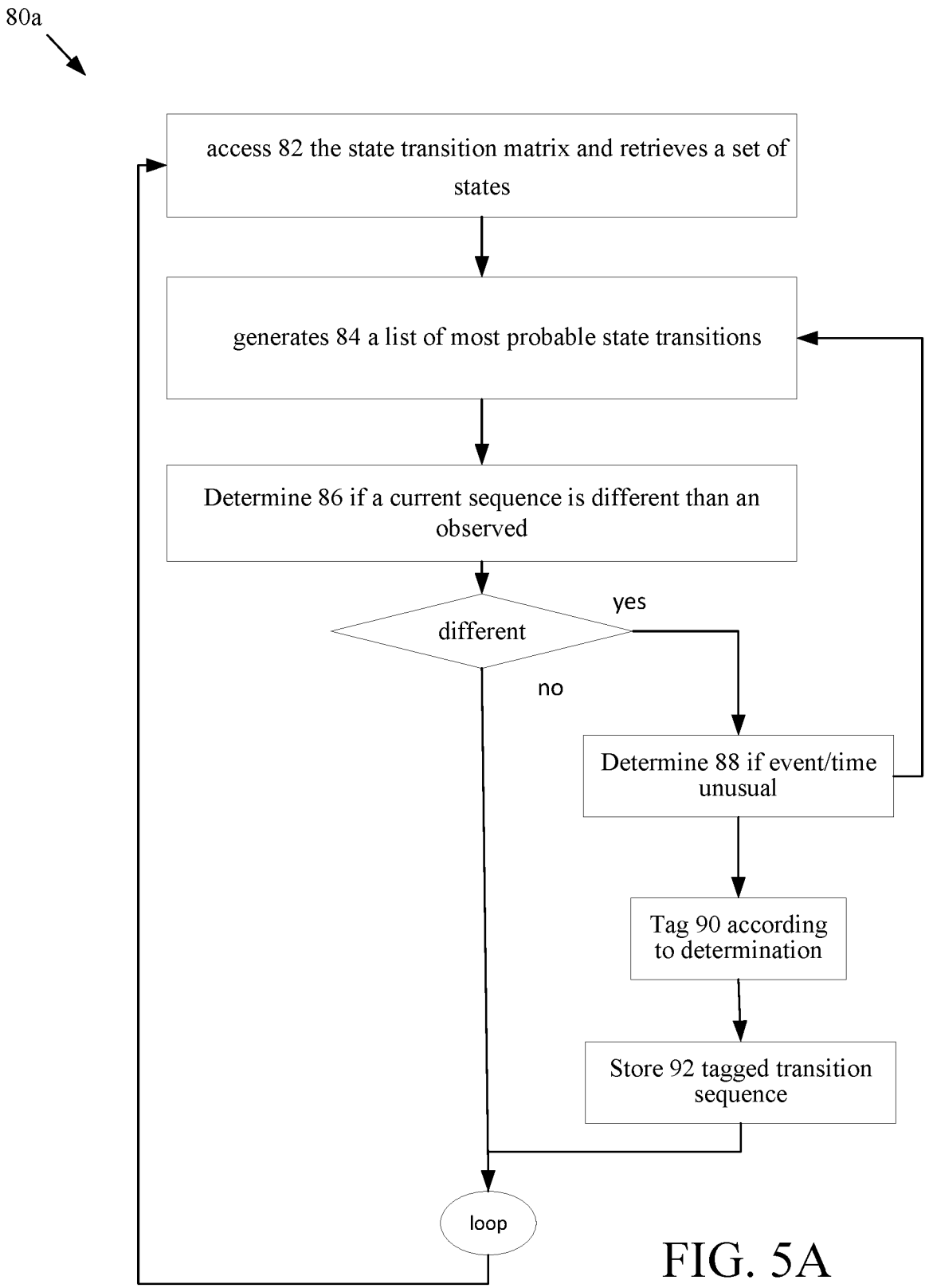
FIG. 5A is a flow diagram of training process for a next state predictor engine that is part of the tiered sensor based state prediction system.

Referring now to FIG. 5A, the training processing 80*a* that is part of the processing 80 for either the Next State Prediction Engines 54*a* or 54*b* is shown. In FIG. 5A, training processing 80' trains the Next State Prediction Engines 54*a*, 54*b*. The Next State Prediction Engines 54*a*, 54*b* access 82 the state transition matrix and retrieves a set of states from the state transition matrix. From the retrieved set of states the Next State Prediction Engines 54*a*, 54*b* generate 84 a list of most probable state transitions for a given time period, the time period can be measured in minutes, hours, days, weeks, months, etc. For example, consider the time period as a day. After a certain time period of active usage, the sensor based state prediction system 50, through the state representation engines 52*a*, 52*b*, has acquired knowledge states s1 to s5.

From the state transition matrix the system uses the so called "Markov property" to generate state transitions. As known, the phrase "Markov property" is used in probability and statistics and refers to the "memoryless" property of a stochastic process.

From the state transition matrix using the so called "Markov property" the system generates state transition sequences, as the most probable state sequences for a given day.

An exemplary sequence uses the above fictitious examples is shown below:

s1 s2 s4 s5 s2 s2 s4 s5

The Next State Prediction Engines 54*a*, 54*b* determine 86 if a current sequence is different than an observed sequence in the list above. When there is a difference, the Next State Prediction Engines 54*a*, 54*b* determine 88 whether something unusual has happened in the premises being monitored or whether the state sequence is a normal condition of the premises being monitored.

With this information the Next State Prediction Engines 54*a*, 54*b* classifies 90 these state transitions as "safe" or "drift state" transitions. Either the Next State Prediction Engines 54*a*, 54*b* or manual intervention is used to label either at the state transition level or the underlying sensor value levels (fictitious) for those state transitions producing the follow:

| Obstruction Detector | Room Thermostat | Stove Thermostat | Safety State (label) |
|---|---|---|---|
| 0 | 71.1755732 | 78.95655605 | G |
| 0 | 68.27180645 | 79.97821825 | G |
| 0 | 71.80483918 | 79.428149 | G |
| 0 | 70.46354628 | 81.90901291 | G |
| 0 | 69.83508114 | 81.12026772 | G |
| 0 | 71.46074066 | 81.613552 | G |
| 1 | 70.14174204 | 80.12242015 | G |
| 1 | 70.98180652 | 78.03049081 | G |
| 0 | 68.58285177 | 79.981358 | G |
| 0 | 69.91571802 | 79.4885171 | G |
| 1 | 69.89799953 | 79.3838372 | G |
| 0 | 70.42668373 | 80.20397118 | G |
| 1 | 70.23391637 | 81.80212485 | Y |
| 0 | 68.19244768 | 81.19203004 | G |

The last column in the above table is the label, wherein in this example "G" is used to indicate green, e.g., a normal operating state, e.g., "a safe state" and "Y" is used to indicate yellow, e.g., an abnormal or drift state, e.g., an "unsafe state" and "R" (not shown above) would be used to represent red or a known unsafe state. This data and states can be stored in the database 51 and serves as training data for a machine learning model that is part of the Next State Prediction Engines 54*a*, 54*b*.

Figure 5B:
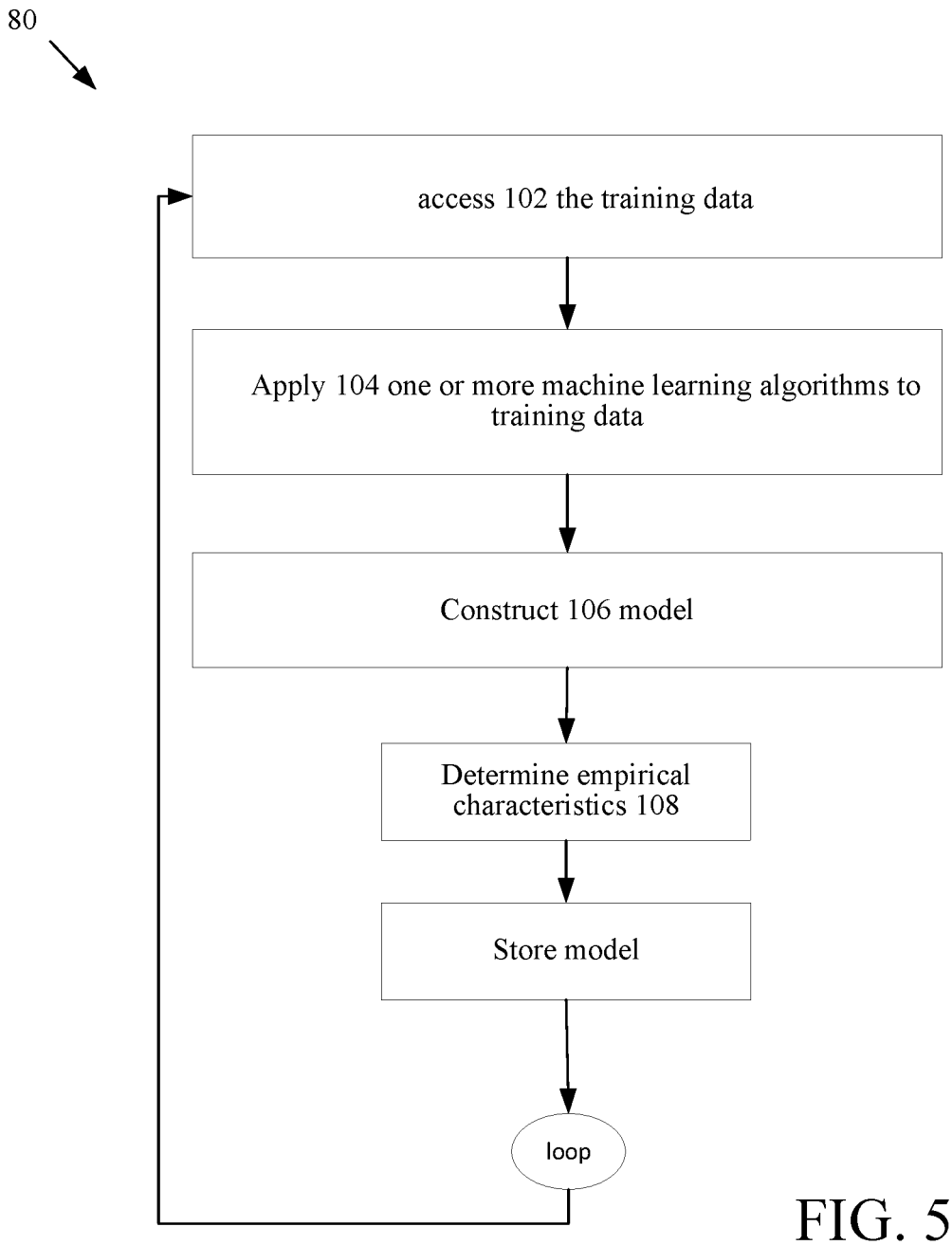
FIG. 5B is a flow diagram of a next state predictor engine model building process.

Referring now to FIG. 5B, the model building processing 80*b* of the Next State Prediction Engines 54*a*, 54*b* is shown. The model building processing 80*b* uses the above training data to build a model that classify a system's state into either a safe state or an unsafe state. Other states can be classified. For example, three states can be defined, as above, "G Y R states" or green (safe state) yellow (drifting state) and red (unsafe state). For ease of explanation two states "safe" (also referred to as normal) and "unsafe" (also referred to as drift) are used. The model building processing 80*b* accesses 102 the training data and applies 104 one or more machine learning algorithms to the training data to produce the model that will execute in the Next State Recommendation Engine 54 during monitoring of systems. Machine learning algorithms such as Linear models and Non-Linear Models, Decision tree learning, etc., which are supplemented with Ensemble methods (where two or more models votes are tabulated to form a prediction) and so forth can be used. From this training data and the algorithms, the model is constructed 106.

Below is table representation of a fictitious Decision Tree using the above fictitious data (again where "G" is used to indicate green, "a safe state" e.g., a normal operating state, and "Y" is used to indicate yellow, e.g., drifting state, and "R" (shown below) to represent red or a known unsafe state. This data and states can be stored in the database 51 and serves as training data for a machine learning model that is part of the Next State Recommendation Engine 54.

```
stoveThermoStat = '(-inf-81.064396]'
| obstructionDetector = 0: G
| obstructionDetector = 1: G
stoveThermoStat = '(81.064396-84.098301]'
| obstructionDetector = 0: G
| obstructionDetector = 1: Y
stove ThermoStat = '(84.098301-87.132207]': R
stoveThermoStat = '(87.132207-90.166112]'
| obstructionDetector = 0: R
| obstructionDetector = 1: R
stoveThermoStat = '(90.166112-inf)'
| obstructionDetector = 0: R
| obstructionDetector = 1: R
```

Empirical characteristics can be a model based and human based are determined 106 for various states of the premises in terms of, e.g., safety of the occupants and operational conditions of the various systems within the premises. Examples of such systems include intrusion detection systems, fire alarm systems, public annunciation systems, burglar alarm systems, the sensors deployed at the premises, as well as other types of equipment, such as refrigeration equipment, stoves, and ovens that may be employed in the kitchen example that will be discussed below. Other instances of particular premises will have other types of systems that are monitored. Based on the empirical determined states of the various systems within the premises being monitored, the sensor based state prediction system 50 will determine the overall state of the premises as well as individual states of the various systems within the premises being monitored, as will be discussed below.

Figure 6:
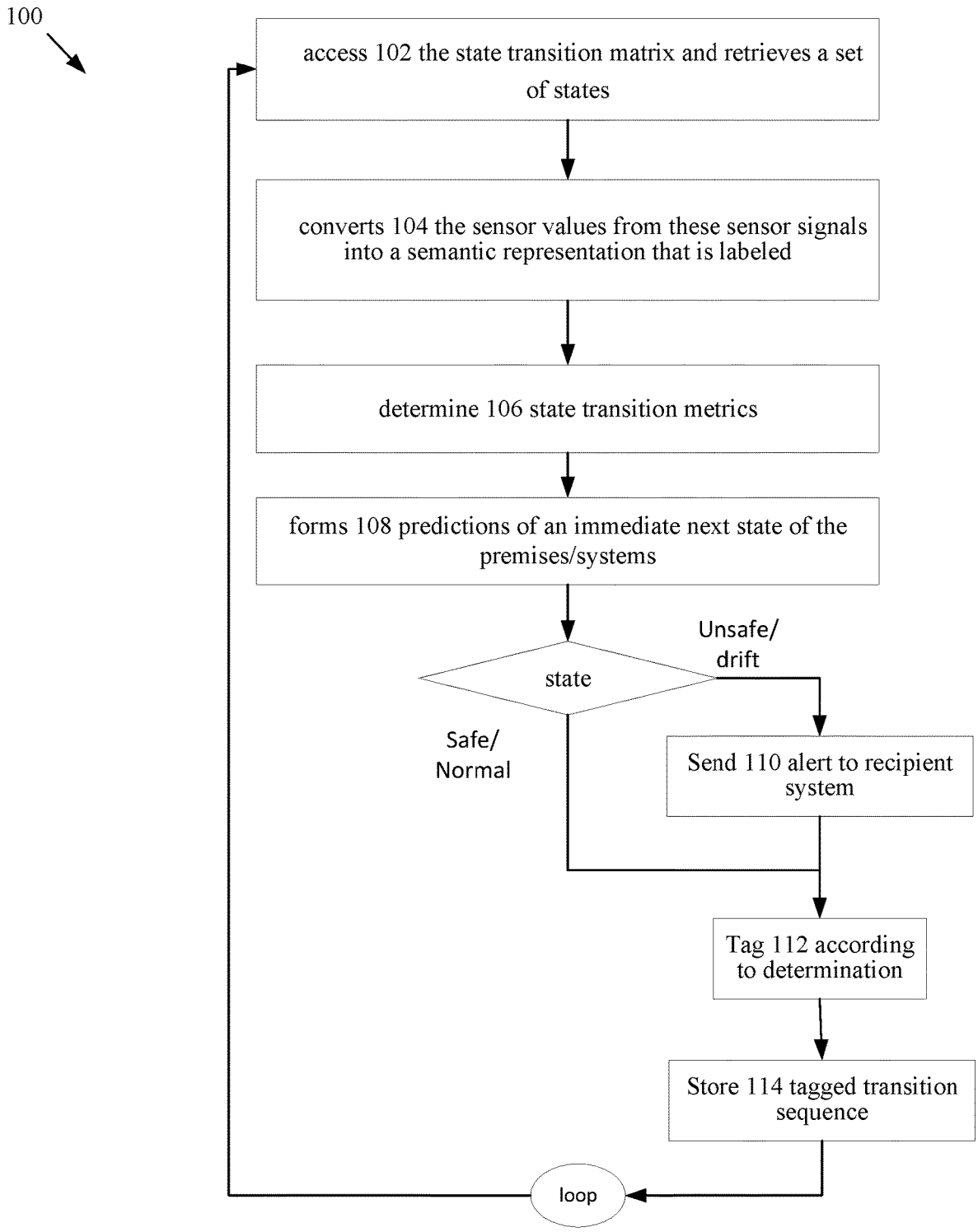
FIG. 6 is a flow diagram of operation processing by the tiered sensor based state prediction system.

Referring now to FIG. 6, operational processing 100 of the sensor based state prediction system 50 is shown. The sensor based prediction system 50 receives 102 (by the State Representation Engines 52*a*, 52*b*) sensor signals from a large plurality of sensors deployed in various premises throughout an area being monitored. The State Representation Engines 52*a*, 52*b* converts 104 the sensor values from these sensor signals into a semantic representation that is identified, as discussed above. As the data is collected continuously, this Engines 52*a*, 52*b* works in an unsupervised manner to determine various states that may exist in sensor data being received from the premises. As the different states are captured, the State Representation Engines 52*a*, 52*b* also determines 106 state transition metrics that are stored in the state transition matrix using both time and events populating the State time trigger and the State event trigger, as discussed above. The State transition matrix is accessed by the Next prediction engine 54 to make decisions and trigger actions by the sensor based state prediction system 50.

The Next State Prediction Engine 54 receives the various states (either from the database and/or from the State Representation Engines 52*a*, 52*b* and forms 108 predictions of an immediate Next state of the premises/systems based the state data stored in the state transition matrix. For such states the Next State Prediction Engine 54 predicts if the premises will be in either a safe state or a drift state over a time period in the Next as discussed above.

The sensor based state prediction system 50 also sends 110 the predictions to the State Representation engine 56 that generates a graphical user interface to provide a graphical user interface representation of predictions and states of various premises/systems. The state is tagged 112 and stored 114 in the state transition matrix.

The sensor based state prediction system 50 using the State Representation Engines 52*a*, 52*b* that operates in a continuous loop to generate new states and the Next State Prediction Engine 54 that produces predictions together continually monitor the premises/systems looking for transition instances that result in drift in states that indicate potential problem conditions. As the sensors in the premises being monitored operate over a period of time, the state transition matrix, the state time trigger matrix and the state event trigger matrix are filled by the state representation engines 52*a*, 52*b* and the Next State Prediction Engine 54 processing 80 improves on predictions.

The sensor based state prediction system 50 thus determines the overall state of the premises and the systems by classifying the premises and these systems into a normal or "safe" state and the drift or unsafe state. Over a period of time, the sensor based state prediction system 50 collects information about the premises and the sensor based state prediction system 50 uses this information to construct a mathematical model that includes a state representation, state transitions and state triggers. The state triggers can be time based triggers and event based triggers, as shown in the data structures above.

Figure 7:
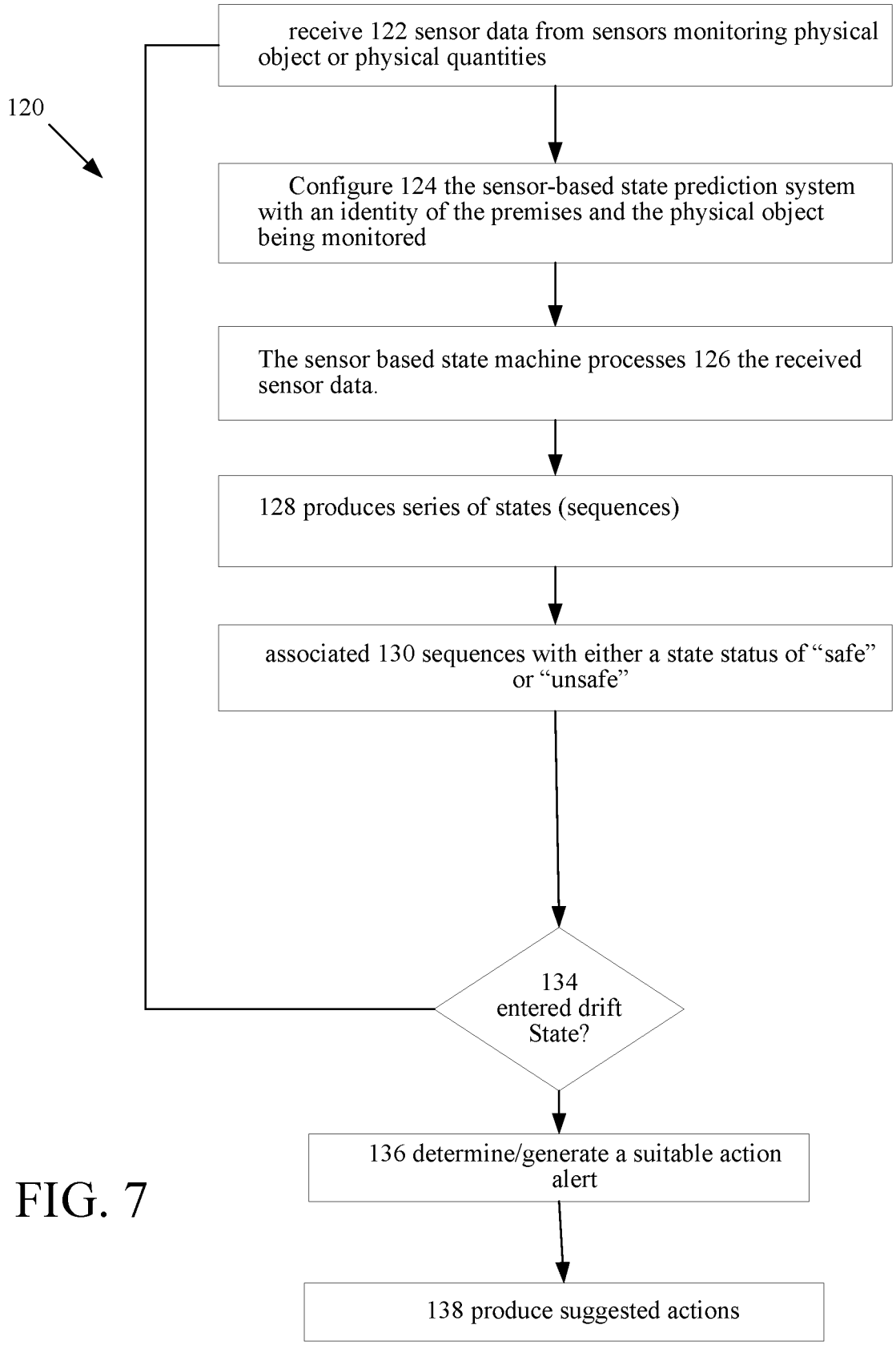
FIG. 7 is a flow diagram of an example of sensor based risk profiling.

Referring now to FIG. 7, processing 120 of sensor information using the architecture above is shown. The sensor-based state prediction system 50 receives 122 sensor data from sensors monitoring each physical object or physical quantity from the sensors (FIG. 2) deployed in a premises. The sensor-based state prediction system 50 is configured 124 with an identity of the premises and the physical objects being monitored by the sensors in the identified premises. The sensor based state machine 50 processes 126 the received sensor data to produce states as set out above using the unsupervised learning models. Using these models the sensor-based state prediction system 50 monitors various physical elements to detect drift states.

For example, one of the sensors can be a vibration sensor that sends the sensor-based state prediction system 50 a signal indicating a level of detected vibration from the vibration sensor. This signal indicates both magnitude and frequency of vibration. The sensor-based state prediction system 50 determines over time normal operational levels for that sensor based on what system that sensor is monitoring and together with other sensors produces 128 series of states for the object and/or premises. These states are associated 130 with either a state status of "safe" or "unsafe" (also referred to herein as "normal" or "drift," respectively). Part of this process of associating is provided by the learning process and this associating can be empirically determined based on human input. This processing thus develops more than a mere envelope or range of normal vibration amplitude and vibration frequency indications for normal operation for that particular vibration sensor, but rather produces a complex indication of a premises or object state status by combining these indications for that sensor with other indications from other sensors to produce the state transition sequences mentioned above.

States are produced from the unsupervised learning algorithms (discussed above in FIGS. 5-5B) based on that vibration sensor and states from other sensors, which are monitoring that object/premises. The unsupervised learning algorithms continually analyze that collected vibration data and producing state sequences and analyze state sequences that include that sensor. Overtime, as the analysis determines 134 that states including that sensor have entered into a drift state that corresponds to an unsafe condition, the sensor-based state prediction system 50 determines 136 a suitable action alert (in the Action layer) to indicate to a user that there may be something wrong with the physical object being monitored by that sensor. The analysis provided by the prediction system sends the alert to indicate that there is something going wrong with object being monitored. The sensor-based state prediction system 50 produces suggested actions 138 that the premises' owner should be taking with respect to the object being monitored. Processing by the sensor-based state prediction system 50 can also include processing of service records of equipment/systems.

Figure 8:
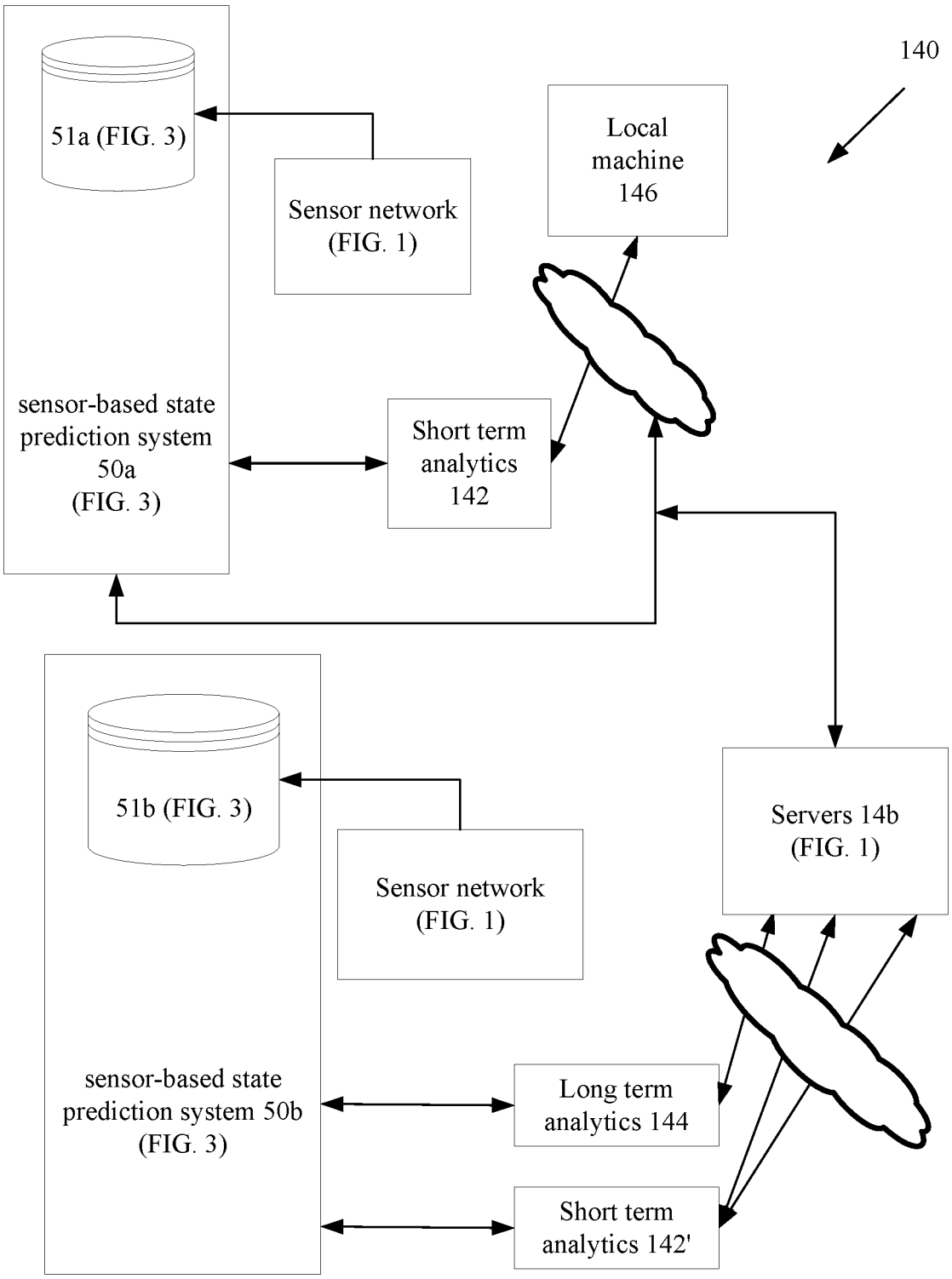
FIG. 8 is a block diagram of a tiered cooperative processing sensor-based state prediction system according to term based analytics.

Referring now to FIG. 8, an architecture 140 that combines the sensor-based state prediction systems 50*a*, 50*b* (FIGS. 1, 3) in a cooperative relationship is shown. In FIG. 8, the sensor-based state prediction systems 50*a*, 50*b* receives sensor data from the sensor network 11 (or storage 51) for a particular premises, processes that data to produce states and state sequences, and uses that information in conjunction with analytics. Analytics can be forwarded to the local machine 146 and/or the server 14*b* executing processing via one or more configuration files 170 (FIG. 10).

The configuration files 170 (an example of which is shown in FIG. 10) can include a listing of the analytics that will run on the local machine 146. Each of the analytics can include a listing of rules that can be fired by the local machines generally 146, a listing sensor devices from which the local machine 146 collects data and a listing of recommended actions based on firing one or more of the rules. Other data/executables can also be included.

For the sensor-based state prediction system 50*a* that system processes what a user considers short term analytics 142. The algorithms that are fed to the sensor-based state prediction system 50*a* seek out short term trends. Examples of such short term analytics 142 include algorithms that examine frame by frame, video data for anomalies that can indicate a short term problem. These short term analytics 142 are selected according to several criteria. For example, one of the criterion is the processing and storage capabilities of the local machine 146. Short-term analytics 142 are those that seek to find anomalies (short term drift states) over a few minutes up to a day or so and that need not has as much data as analytics that seek anomalies (drift states) over days to months.

Conversely, long term analytics 144 are any other analytic that is not classified as short term analytics 142. The demarcation between short term and long term analytics 142, 144 is user selectable and would vary according to nature of the premises, the types of sensors, and the processing capabilities of the local machine 146. In as much as the long term analytics 144 are executed on sensor-based state prediction system 50*b* deployed in the cloud and for many premises, these servers, e.g., server 14*b*, are far more powerful in terms of computation and storage, etc., than those of the local machine 146. Both short term analytics 142' and long term analytics can run o server 14*b*, as shown in FIG. 8.

Either sensor-based state prediction system 50*a*, 50*b* generates alerts. The sensor-based state prediction system 50 produces for a given premises listings of state sequences that can be safe sequences and unsafe, i.e., drift sequences that can be predicted events, and which result in alerts being sent with suggested actions that the premises' owner should take. The sensor-based state prediction system 50 also tracks resolutions of those anomalies. The sensor-based state prediction system 50 thus produces profiles based on the state sequences for each premises being monitored.

An example of a particular analytic will now be described. Assume that a kitchen is limited to producing an aggregate of M British Thermal Units (BTU's) of heat. An exemplary analytic evaluates a state condition or a drift state against this exemplary rule Rule total BTU<M BTU's The sensor based prediction engine 50*a* forms a state sequence S34 S24 S60. Assume for the example that this sequence indicates that the heat being generated by the stoves in the kitchen exceed M BTU's. This rule would fire and generate an alert that can be communicated to the sensor based prediction engine 50*b*, as well as to a user device as in FIG. 7 with a suggested action.

In the system architecture, the sensor data is received by the local machine 146 that provides a first level of data analysis. At the same time or subsequent to the local processing, that data is also transmitted to the cloud based servers for analysis for further and often more intensive processing. This allows the local machine 146 to perform quick, less computationally intense, analysis of the data such that immediate actions can be initiated. The cloud based analysis can be more computationally demanding, but will incur latency due to the additional time needed to transmit the data from the local premises to the cloud, perform the analysis (which may be more intensive), and initiate a response.

Therefore, the local machine 146 is configured with a limited set of analytics that the local machine 146 can perform very quickly, and that set of analytics as well as other sets of analytics that are less time sensitive and more computationally intensive are performed by the cloud based servers. The analytics performed in the cloud could also be performed as a post processing operation, i.e., after the data is stored and the system is finished with other more urgent operations. Analytics that need to be processed the fastest are performed by the local system to provide a faster response time.

An example of another analytic will now be described. This analytic is an example of a long term analytic 144.

Assume that a hood in a kitchen is limited to expelling an aggregate of X*N British Thermal Units (BTU's) of heat over a period of 500 days, without checking a thermal sensor built into the hood. An exemplary analytic evaluates a state condition or a drift state against this exemplary rule.

Rule total BTU in hood<500*N BTU's

The sensor based prediction engine 50*b* forms a state sequence S44 S4 S90. Assume for the example that this sequence indicates that the heat being expelled from the hood in the kitchen exceed 55*N BTU's. This rule would fire and generate an alert that can be communicated to the sensor based prediction engine 50*a* as well as to a user device as in FIG. 7 with a suggested action.

In this instance, because the sensor based prediction engine 50*b* executes, e.g., in the cloud, it can store more data and can evaluate rules that seek out long-term trends, etc.

Figure 9:
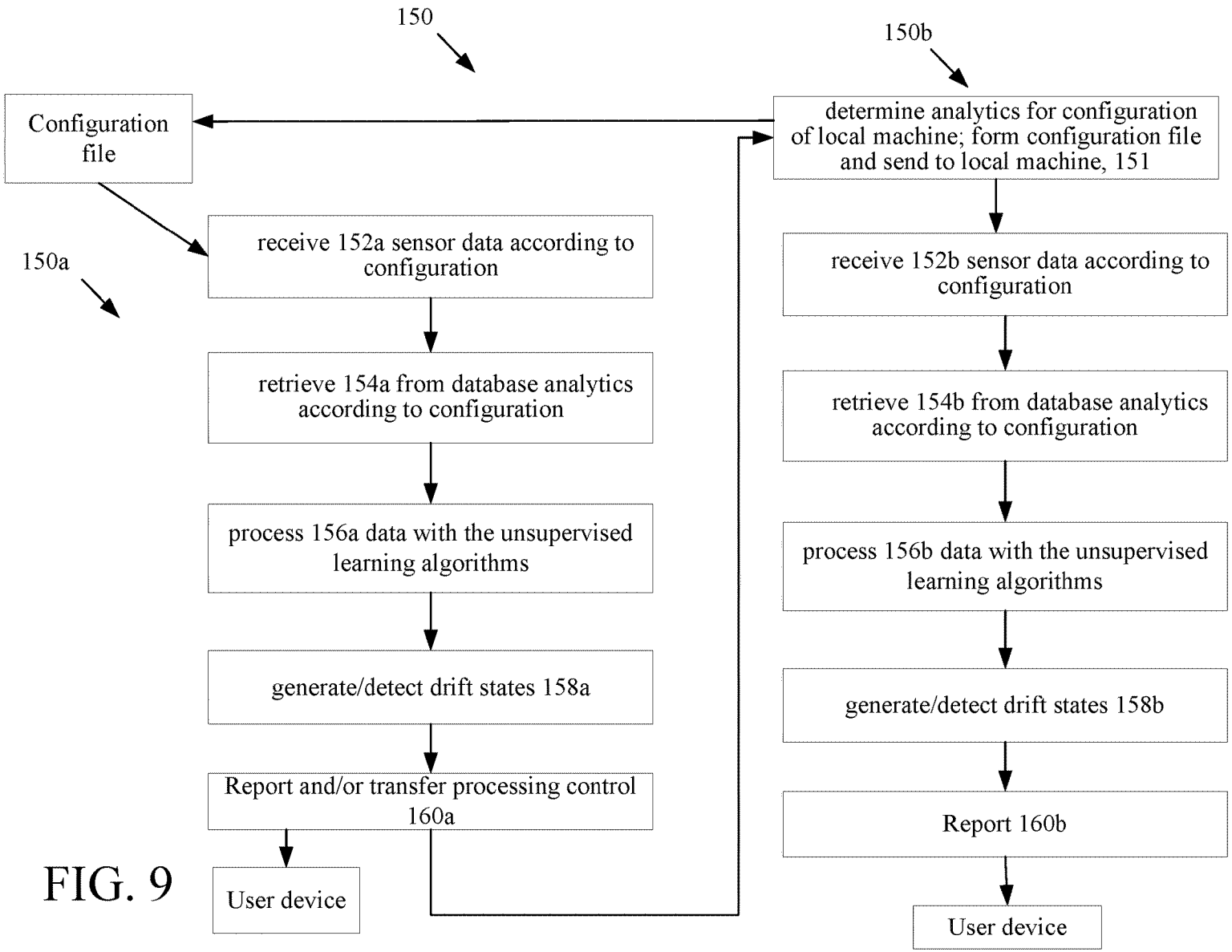
FIG. 9 is a flow diagram of the tiered cooperative processing sensor-based state prediction system of FIG. 8.

Referring now to FIG. 9, an example of tiered processing on the sensor-based state prediction systems 50*a*, 50*b* (FIGS. 1, 3) is shown. In FIG. 9, the sensor-based state prediction systems 50*a*, 50*b* each receives 152*a*, 152*b* sensor data from the sensor network 11 (or storage 51) for a particular premises, retrieve analytics 154*a*, 154*b*, process 156*a*, 156*b* that data to produce states and state sequences 156*a*, 156*b*, detects drift states 158*a*, 158*b*, and generates 160*a*, 160*b* reporting information. The reporting from local machine processing 150*a* can be forwarded from the local machine 146 to the server 14*b* executing processing.

In some instances, reporting by the local machine can include a transfer of control of the processing back to the server 14*b*, meaning that the server 14*b* continues processing of the analytic that was being processed by the local machine 25.

The server 14*b* executing sensor-based state prediction system 50*b* can produce or retrieve new analytics or rules that are packaged in one or more of the configuration files 170 (FIG. 10) that are sent back to the local machine for further processing.

Various combinations of the above described processes are used to implement the features described.

Servers interface to the sensor based state prediction system 50 via a cloud computing configuration and parts of some networks can be run as sub-nets. In some embodiments, the sensors provide in addition to sensor data, detailed additional information that can be used in processing of sensor data evaluate. For example, a motion detector could be configured to analyze the heat signature of a warm body moving in a room to determine if the body is that of a human or a pet. Results of that analysis would be a message or data that conveys information about the body detected. Various sensors thus are used to sense sound, motion, vibration, pressure, heat, images, and so forth, in an appropriate combination to detect a true or verified alarm condition at the intrusion detection panel.

Recognition software can be used to discriminate between objects that are a human and objects that are an animal; further facial recognition software can be built into video cameras and used to verify that the perimeter intrusion was the result of a recognized, authorized individual. Such video cameras would comprise a processor and memory and the recognition software to process inputs (captured images) by the camera and produce the metadata to convey information regarding recognition or lack of recognition of an individual captured by the video camera. The processing could also alternatively or in addition include information regarding characteristic of the individual in the area captured/monitored by the video camera. Thus, depending on the circumstances, the information would be either metadata received from enhanced motion detectors and video cameras that performed enhanced analysis on inputs to the sensor that gives characteristics of the perimeter intrusion or a metadata resulting from very complex processing that seeks to establish recognition of the object.

Sensor devices can integrate multiple sensors to generate more complex outputs so that the intrusion detection panel can utilize its processing capabilities to execute algorithms that analyze the environment by building virtual images or signatures of the environment to make an intelligent decision about the validity of a breach.

Memory stores program instructions and data used by the processor of the intrusion detection panel. The memory may be a suitable combination of random access memory and read-only memory, and may host suitable program instructions (e.g. firmware or operating software), and configuration and operating data and may be organized as a file system or otherwise. The stored program instruction may include one or more authentication processes for authenticating one or more users. The program instructions stored in the memory of the panel may further store software components allowing network communications and establishment of connections to the data network. The software components may, for example, include an internet protocol (IP) stack, as well as driver components for the various interfaces. Other software components suitable for establishing a connection and communicating across network will be apparent to those of ordinary skill.

Program instructions stored in the memory, along with configuration data may control overall operation of the system. Servers include one or more processing devices (e.g., microprocessors), a network interface and a memory (all not illustrated). Servers may physically take the form of a rack mounted card and may be in communication with one or more operator terminals (not shown). An example monitoring server is a SURGARD™ SG-System III Virtual, or similar system.

The processor of each monitoring server acts as a controller for each monitoring server, and is in communication with, and controls overall operation, of each server. The processor may include, or be in communication with, the memory that stores processor executable instructions controlling the overall operation of the monitoring server. Suitable software enable each monitoring server to receive alarms and cause appropriate actions to occur. Software may include a suitable Internet protocol (IP) stack and applications/clients.

Each monitoring server of the central monitoring station may be associated with an IP address and port(s) by which it communicates with the control panels and/or the user devices to handle alarm events, etc. The monitoring server address may be static, and thus always identify a particular one of monitoring server to the intrusion detection panels. Alternatively, dynamic addresses could be used, and associated with static domain names, resolved through a domain name service.

The network interface card interfaces with the network to receive incoming signals, and may for example take the form of an Ethernet network interface card (NIC). The servers may be computers, thin-clients, or the like, to which received data representative of an alarm event is passed for handling by human operators. The monitoring station may further include, or have access to, a subscriber database that includes a database under control of a database engine. The database may contain entries corresponding to the various subscriber devices/processes to panels like the panel that are serviced by the monitoring station.

All or part of the processes described herein and their various modifications (hereinafter referred to as "the processes") can be implemented, at least in part, via a computer program product, i.e., a computer program tangibly embodied in one or more tangible, physical hardware storage devices that are computer and/or machine-readable storage devices for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing the processes can be performed by one or more programmable processors executing one or more computer programs to perform the functions of the calibration process. All or part of the processes can be implemented as, special purpose logic circuitry, e.g., an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer (including a server) include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, e.g., magnetic, magneto-optical disks, or optical disks.

Tangible, physical hardware storage devices that are suitable for embodying computer program instructions and data include all forms of non-volatile storage, including by way of example, semiconductor storage area devices, e.g., EPROM, EEPROM, and flash storage area devices; magnetic disks, e.g., internal hard disks or removable disks; magneto-optical disks; and CD-ROM and DVD-ROM disks and volatile computer memory, e.g., RAM such as static and dynamic RAM, as well as erasable memory, e.g., flash memory.

In addition, the logic flows depicted in the figures do not require the particular order shown, or sequential order, to achieve desirable results. In addition, other actions may be provided, or actions may be eliminated, from the described flows, and other components may be added to, or removed from, the described systems. Likewise, actions depicted in the figures may be performed by different entities or consolidated.

Elements of different embodiments described herein may be combined to form other embodiments not specifically set forth above. Elements may be left out of the processes, computer programs, Web pages, etc. described herein without adversely affecting their operation. Furthermore, various separate elements may be combined into one or more individual elements to perform the functions described herein.

Other implementations not specifically described herein are also within the scope of the following claims.

What is claimed is:

1. A networked system for detecting conditions at a physical premises, the networked system comprising:

a local computer system comprising: a processing device, memory operatively coupled to the processing device and a storage device storing a computer program product for detecting conditions at the physical premises, the computer program product comprising instructions to configure the local computer system to:

configure the local computer system with a configuration file that determines processing performed by the local computer system, with the configuration file including a listing of analytics to execute on the local computer system and a listing of plural sensor devices from which the local computer system collects sensor data, the local computer system configured by the configuration file to:

collect sensor information from at least some of the plural sensor devices deployed in the physical premises, the collected sensor information including an identity of the physical premises and physical objects being monitored by the sensors in the identified physical premises, and the sensor data;

execute one or more unsupervised learning models that are identified in the listing of analytics, which one or more unsupervised learning models analyze the sensor data to produce operational levels of at least some of the plural sensor devices, and local determined sequences of state transitions;

detect one or more local drift state sequences by correlating the one or more local determined sequences of state transitions to one or more stored determined conditions; and report the one or more local detected drift state sequences while transferring processing control of the collected sensor information from the local computer to a remote computer system for continued processing of the one or more unsupervised learning models; and the remote computer system comprising:

a processing device, memory operatively coupled to the processing device, and a storage device storing a computer program product, the computer program product for detecting conditions at the physical premises, the computer program product comprising instructions to cause a processor to:

receive an indication of a transfer of processing control from the local computer system to the remote computer system;

receive the collected sensor information including the sensor data from the at least some of the plural sensor devices deployed in the physical premises;

produce or retrieve new analytics or rules based on the one or more local drift state sequences;

package the produced or retrieved new analytics or rules in one or more new configuration files;

send the one or more new configuration files to the local computer system for processing; and detect one or more remote drift state sequences.

2. The networked system of claim 1 wherein the configuration file is a first configuration file and the remote computer system is further configured to:

read a second configuration file that determines processing performed by the remote computer system.

3. The networked system of claim 1 wherein the one or more local drift state sequences are short term drift state sequences and the one or more remote drift state sequences are long term drift state sequences relative to the short term drift state sequences with long term and short term being temporal terms.

4. The networked system of claim 1 wherein the local computer system is configured with the analytics that are less time sensitive than a set of analytics executed on the remote computer system with time sensitivity being measured according to a time period specified in the rules.

5. A computer implemented method comprises:

collecting by a local computer system, sensor information from plural sensor devices deployed in a premises, the sensor information including an identity of the premises, physical objects being monitored by the plural sensor devices in the identified premises, and sensor data collected from the plural sensors;

configuring the local computer system with a configuration file that determines processing performed by the local computer system, with the configuration file including a listing of analytics to execute on the local computer system and a listing of plural sensor devices from which the local computer system collects the sensor data; with the local computer system configured by the configuration file for:

executing by the local computer system one or more unsupervised learning models identified from the listing of analytics to continually analyze the sensor data to produce operational states of the sensor devices and sequences of state transitions, detecting one or more local drift sequences by correlating the one or more determined sequences of state transitions to one or more stored learned conditions, and reporting the one or more local detected drift state sequences while transferring processing control of the collected sensor information from the local computer to a remote computer system for continued processing of the one or more unsupervised learning models;

receiving by the remote computer system, an indication of a transfer of processing control from the local computer system to the remote computer system;

receiving by the remote computer system, the collected sensor information;

producing or retrieve new analytics or rules based on the one or more local drift sequences;

packaging the produced or retrieved new analytics or rules in one or more new configuration files;

sending the one or more new configuration files to the local computer system for processing; and detecting by the remote computer system one or more remote drift sequences.

6. The method of claim 5 wherein the configuration file is a first configuration file and the method further comprises:

reading a second configuration file that determines processing performed by the remote computer system.

7. The method of claim 5 wherein the one or more local drift sequences are short term drift sequences and the remote drift sequences are long term drift sequences relative to the short term drift sequences with long term and short term being temporal terms.

8. The networked system of claim 1 wherein the remote computer system is further configured to:

read a second configuration file that determines processing performed by the remote computer system; and execute according to the second configuration file one or more unsupervised learning models to continually analyze the received sensor data to produce operational states of at least some of the sensor devices and sequences of state transitions to detect the one or more remote drift state sequences by correlating the one or more remote determined sequences of state transitions to one or more stored determined conditions.

9. The networked system of claim 8 further configured to:

generate an alert by the local computer system and the remote computer system based on the one or more local detected and/or remote drift sequences; and send the generated alert to a user device.

10. The method of claim 5 wherein the method further comprises:

reading a second configuration file that determines processing performed by the remote computer system; and executing by the remote computer system according to the second configuration file one or more unsupervised learning models to continually analyze the received sensor data to produce operational states of the sensor devices and remote determined sequences of state transitions to detect the one or more remote drift sequence by correlating one or more remote determined sequences of state transitions to one or more stored determined conditions.

11. The method of claim 10 wherein the method further comprises:

generating an alert by the local computer system and the remote computer system based on one or more drift sequences; and sending the generated alert to a user device.

12. A networked system, comprising:

a local computer configured to:

configure the local computer system with a configuration file that determines processing performed by the local computer system, wherein the configuration file includes a listing of analytics to execute on the local computer system and a listing of sensor devices from which the local computer system collects sensor data, the local computer system configured by the configuration file to:

collect the sensor data;

execute one or more unsupervised learning models that are identified in the listing of analytics, which one or more unsupervised learning models analyze the sensor data to produce operational levels of at least some of the sensor devices, and local determined sequences of state transitions;

detect one or more local drift state sequences by correlating the one or more local determined sequences of state transitions to one or more stored determined conditions; and report the one or more local detected drift state sequences while transferring processing control of the collected sensor information from the local computer to a remote computer system for continued processing of the one or more unsupervised learning models, and the remote computer system configured to:

receive an indication of a transfer of processing control from the local computer system to the remote computer system;

receive the sensor data;

produce or retrieve new analytics or rules based on the one or more local drift state sequences;

package the produced or retrieved new analytics or rules in one or more new configuration files;

send the one or more new configuration files to the local computer system for processing: and detect one or more remote drift state sequences.

13. The networked system of claim 12 wherein the configuration file is a first configuration file and the remote computer system is further configured to:

read a second configuration file that determines processing performed by the remote computer system.

14. The networked system of claim 12 wherein the one or more local drift state sequences are short term drift state sequences and the one or more remote drift state sequences are long term drift state sequences relative to the short term drift state sequences with long term and short term being temporal terms.

15. The networked system of claim 12 wherein the local computer system is configured with the analytics that are less time sensitive than a set of analytics executed on the remote computer system with time sensitivity being measured according to a time period specified in the rules.

16. The networked system of claim 12 wherein the local computer system is further configured to:

collect sensor information from at least some of the sensor devices deployed in a physical premises, wherein the sensor information includes an identity of the physical premises and physical objects being monitored by the sensors in the identified physical premises, and the sensor data.

* * * * *